US007373914B2

(12) United States Patent
Hoi

(10) Patent No.: US 7,373,914 B2
(45) Date of Patent: May 20, 2008

(54) LUBRICATING APPARATUS FOR INTERNAL COMBUSTION ENGINE

(75) Inventor: Yosuke Hoi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/798,872

(22) Filed: May 17, 2007

(65) Prior Publication Data

US 2007/0266986 A1 Nov. 22, 2007

(30) Foreign Application Priority Data

May 19, 2006 (JP) ..... 2006-139788

(51) Int. Cl.
*F01M 1/00* (2006.01)

(52) U.S. Cl. ..... 123/196 R; 123/196 S

(58) Field of Classification Search ..... 123/196 R, 123/196 S

See application file for complete search history.

(56) References Cited

U.S. PATENT DOCUMENTS 4,583,500 A * 4/1986 Hundertmark ..... 123/73 AD
5,063,895 A * 11/1991 Ampferer ..... 123/196 R
5,918,573 A * 7/1999 Killion ..... 123/192.2
6,761,142 B2 * 7/2004 Suzuki et al. ..... 123/196 R
7,011,069 B2 * 3/2006 Ono et al. ..... 123/196 R
7,055,489 B2 * 6/2006 Kurokawa et al. ..... 123/196 R
7,219,645 B2 * 5/2007 Lamb et al. ..... 123/196 R
7,240,656 B2 * 7/2007 Yamane et al. ..... 123/196 R
7,287,508 B2 * 10/2007 Kurihara ..... 123/196 R
7,299,780 B1 * 11/2007 Thompson ..... 123/196 R

FOREIGN PATENT DOCUMENTS

JP 2003-27915 A 1/2003

* cited by examiner

*Primary Examiner*—Stephen K. Cronin
*Assistant Examiner*—Jason Benton
(74) *Attorney, Agent, or Firm*—Birch, Stewart, Kolasch & Birch, LLP

(57) ABSTRACT

A lubricating apparatus for an internal combustion engine is provided in which an oil discharge passage, extending from the oil pump, is provided for straddling the oil pump case and the tank body. A direction of the extension of the oil discharge passage is changed in the tank body such that the oil discharge passage further extends in parallel with a junction plane between the oil pump case and the tank body. An opening for pressure reception by a relief valve is provided in the oil discharge passage portion extending in parallel with the junction plane. By attaching the oil pump case such that an outside end portion of the relief valve is held by a portion of the oil pump case, the relief valve is fixed between the tank body and the oil pump case.

20 Claims, 6 Drawing Sheets

LUBRICATING APPARATUS FOR INTERNAL COMBUSTION ENGINE

CROSS-REFERENCE TO RELATED APPLICATIONS

The present application claims priority under 35 USC 119 to Japanese Patent Application No. 2006-139788 filed on May 19, 2006 the entire contents of which are hereby incorporated by reference.

BACKGROUND OF THE INVENTION

1. Field of the Invention

The present invention relates to a lubricating apparatus for an internal combustion engine and more particularly to a method of fixing a relief valve for an oil pump.

2. Description of Background Art

A relief valve for an oil pump used to be fixed by forming an opening for pressure reception in a portion of an oil pump case, fitting an inside end portion of the relief valve into the opening, holding an outside end portion of the relief valve by a tank cover, and fixing the relief valve with bolts, not illustrated. Such a relief valve used to be positioned in a front portion of an oil pump, causing an associated oil tank to be large in the front-rear direction. See for example JP-A No. 2003-27915, FIG. 8, paragraph 0023.

SUMMARY AND OBJECTS OF THE INVENTION

The present invention is aimed at providing an easy means of installing a relief valve and miniaturizing an oil tank.

To achieve the aim, the present invention provides a lubricating apparatus for an internal combustion engine, including: a tank body attached to an end face of an internal combustion engine crankcase with an oil pump case attached to an end face of the tank body. The oil pump case houses an oil pump; and a tank cover attached to the tank body with the tank cover covering the oil pump case. In the lubricating apparatus for an internal combustion engine: an oil discharge passage extending from the oil pump is provided that straddles the oil pump case and the tank body. A direction of extension of the oil discharge passage is changed in the tank body such that the oil discharge passage further extends, in the tank body, in parallel with a junction plane between the oil pump case and the tank body. An opening for pressure reception by a relief valve is provided in the oil discharge passage portion extending in parallel with the junction plane. An inside end portion of the relief valve is fitted into the opening in a direction in which the oil pump case is attached. By attaching the oil pump case such that an outside end portion of the relief valve is held by a portion of the oil pump case, the relief valve is fixed between the tank body and the oil pump case.

According to an embodiment of the present invention, no special bolts for fixing a relief valve are required. This is effective in reducing the number of components and shortening the assembly process. In addition, it is not necessary to form a hole in an oil pump case. Furthermore, no relief valve is disposed in the front portion of the oil pump, so that the dimension in the front-rear direction of the front portion of the oil tank can be reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
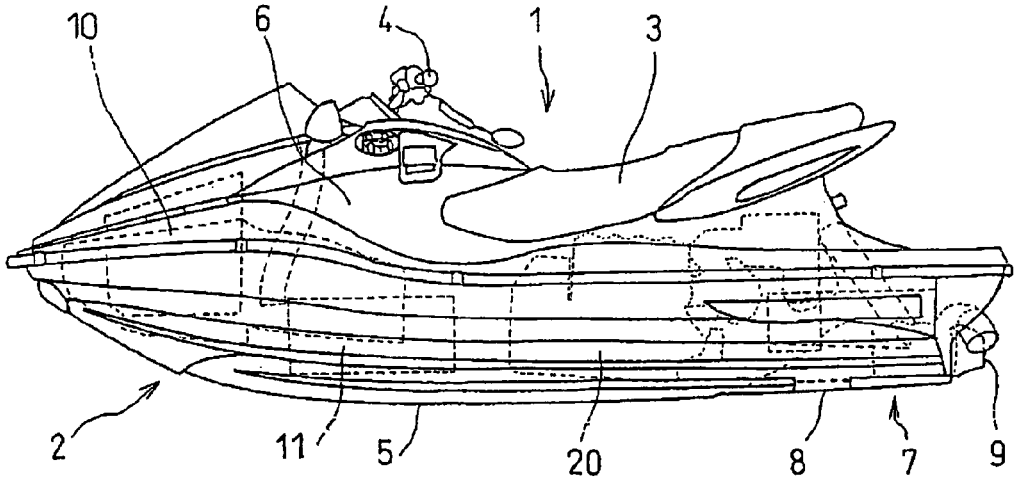
FIG. 1 is a side view of a small planing boat 1 equipped with an internal combustion engine 20 according to the present invention.
Figure 2:
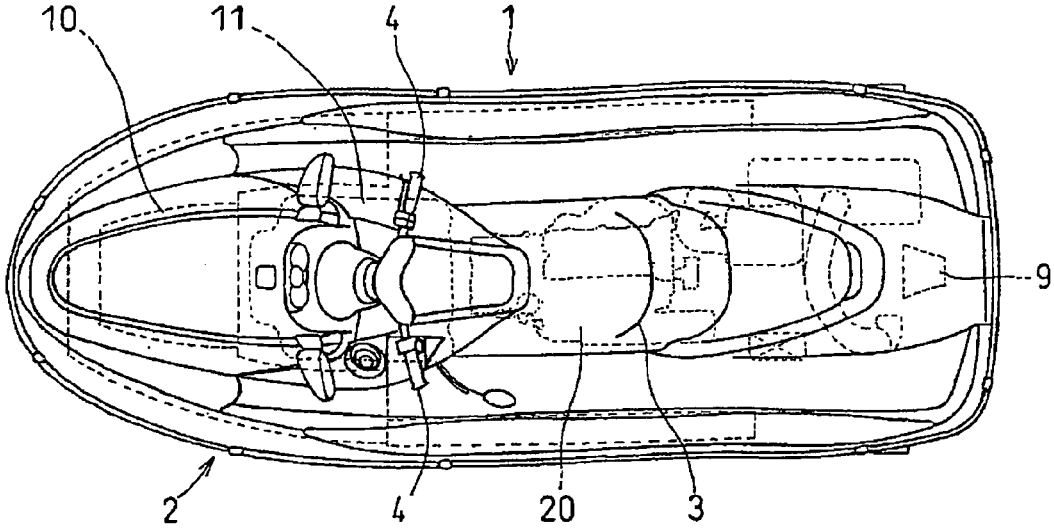
FIG. 2 is a plan view of the small planing boat 1.
Figure 3:
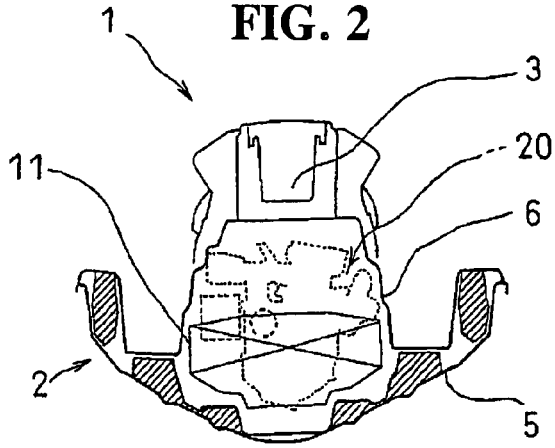
FIG. 3 is a cross-sectional rear view of the small planing boat 1.

FIG. 1 is a side view of a small planing boat 1 equipped with an internal combustion engine 20 according to the present invention, FIG. 2 is a plan view of the small planing boat 1 and FIG. 3 is a cross-sectional rear view of the small planing boat 1. The small planing boat 1 is a small saddle-ride type boat. The driver drives the boat straddling a seat 3 on a boat body 2 and gripping a steering handlebar 4 attached with a throttle lever. The boat body 2 is a floating structure which includes a hull 5 and a deck 6 joined together for forming an internal space. An internal combustion engine 20 is mounted on the hull 5 inside the space. A jet pump 7 which is a propulsion means driven by the internal combustion engine 20 is disposed at a rear of the hull 5. As shown in FIG. 1, the jet pump 7 includes a flow passage leading from a water intake opening 8 formed in the bottom of the boat to a nozzle 9 which is open at the rear end of the boat body 2 and an impeller disposed in the flow passage. The shaft of the impeller is linked to the output shaft of the internal combustion engine 20. The drive rotation speed of the internal combustion engine 20 is controlled by turning the throttle lever attached to the steering handlebar. A nozzle 9 is linked to the handlebar by an operating wire (not shown). Operating the handlebar turns the nozzle 9 for steering. A stowage space 10 is provided in a front portion of the boat body. A fuel tank 11 is positioned in a longitudinal middle portion of the bottom of the boat body.

Figure 4:
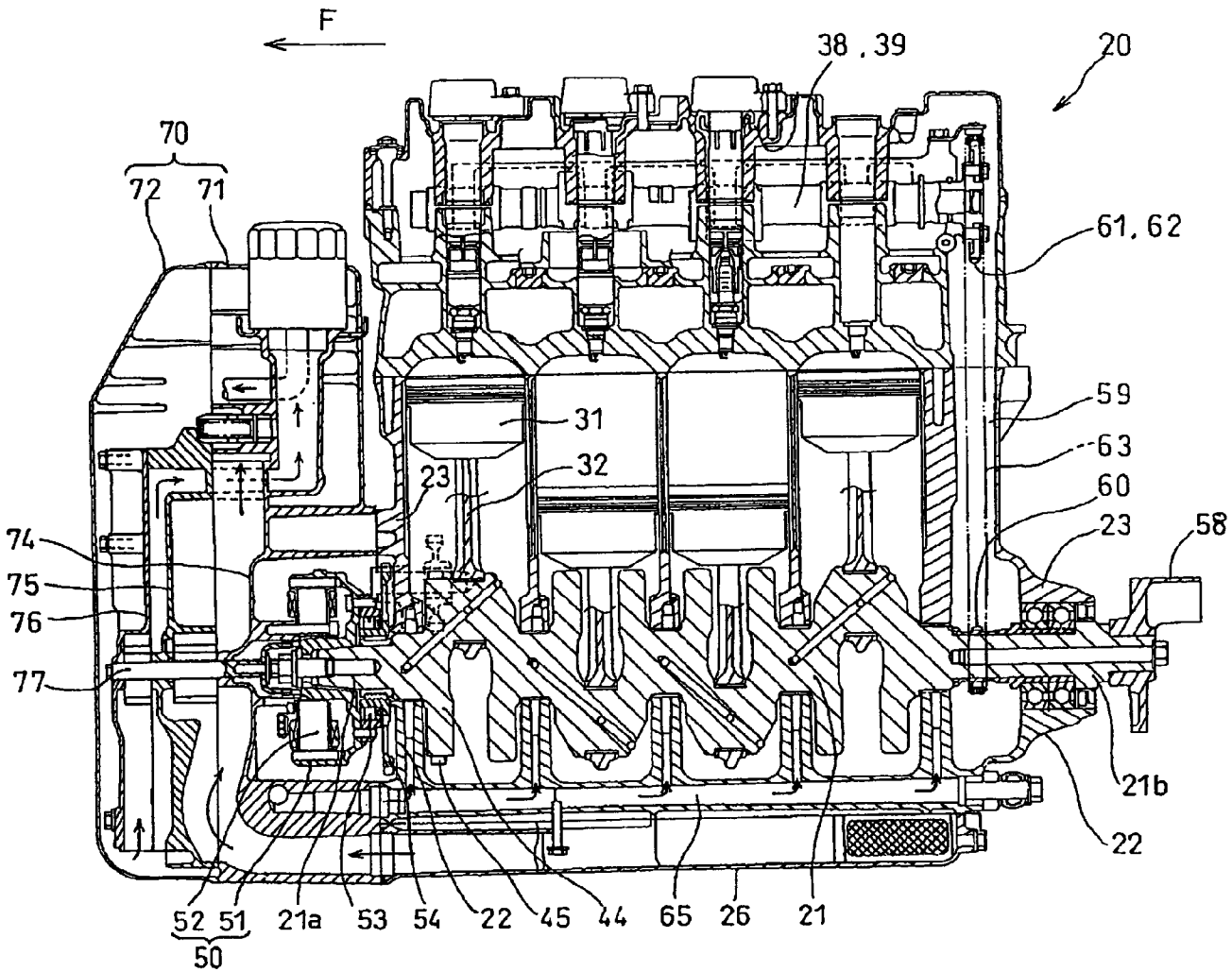
FIG. 4 is a longitudinal cross-sectional view of the internal combustion engine 20 as seen from the left side.
Figure 5:
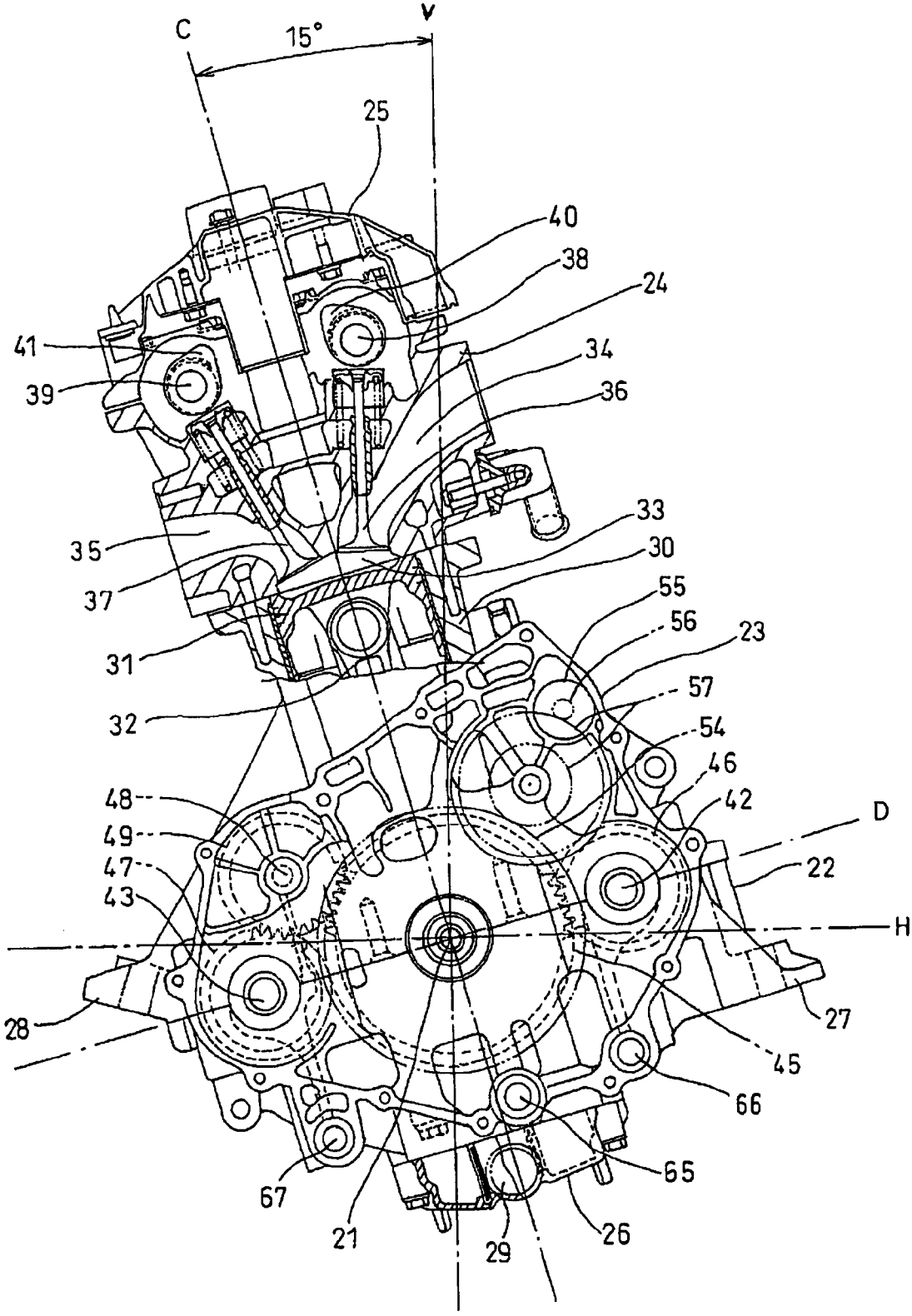
FIG. 5 is a transversal cross-sectional view of the internal combustion engine 20 as seen from the front.

FIG. 4 is a longitudinal cross-sectional view of the internal combustion engine 20 as seen from the left side with respect to the forward direction of the boat. In FIG. 4, the arrow F points in the forward direction. FIG. 5 is a transversal cross-sectional view of the internal combustion engine 20 as seen from the front of the boat. In FIG. 5, "V"

denotes a vertical plane of the boat body 2, "C" the cylinder axis of the internal combustion engine 20, "H" a horizontal plane of the boat body 2, and "D" the parting plane (joining plane) between a crankcase 22 and a cylinder block 23 of the internal combustion engine 20.

The internal combustion engine is a DOHC, inline four-cylinder, four-cycle engine using a dry sump system with a crankshaft 21 oriented in the front-rear direction of the boat body as shown in FIG. 4. In the present specification, left and right are as seen in the forward direction of the boat. As shown in FIG. 5 (front view), the internal combustion engine 20 is installed in a rightwardly inclined position as viewed in the forward direction of the boat. This is for convenience in adjusting and handling many auxiliary devices attached together to the left side of the boat as viewed in the forward direction of the boat and connected to an intake port 34.

The body of the internal combustion engine includes the crankcase 22 and cylinder block 23 joined together such that the crankshaft 21 is rotatably held in the parting plane between them. A cylinder head 24 is placed over the cylinder block 23 with a head cover 25 placed on top of the cylinder head 24. An oil pan 26 is attached under the crankcase 22.

The internal combustion engine is mounted on the hull 5 by having its mounting brackets, provided on its front and rear left and right sides, fixed to mounts provided in the corresponding positions on the hull 5. Left mounting brackets 27 are projectingly provided on the left side of the crankcase 22. Right mounting brackets 28 are projectingly provided on the right side of the cylinder block 23. The left and right mounting brackets are fixed to the hull 5 on the same horizontal level. The cylinder axis C is perpendicular to the parting plane. The cylinder head 24 and head cover 25 are positioned in the direction of the cylinder axis C. The oil pan 26 is also provided in a lower position in the same direction. The angle formed between the cylinder axis C and the vertical plane V of the boat body is 15 degrees.

Referring to FIG. 5, a piston 31 reciprocates in the rightwardly inclined cylinder 30, causing, via a connecting rod 32, the crankshaft 21 to rotate. A combustion chamber 33 facing the top face of the piston 31 is formed inside the cylinder head 24 placed over the cylinder 30. Inside the cylinder head 24, an intake port 34 and an exhaust port 35 each with one end open into the combustion chamber 33 are also formed to extend on the left and right sides, respectively. The openings into the combustion chamber of the intake port 34 and exhaust port 35 are closed and opened by an intake valve 36 and an exhaust valve 37, respectively. The intake valve 36 and the exhaust valve 37 are opened and closed by being driven by cams 40 and 41 mounted on a cam shaft 38 on the intake side and a cam shaft 39 on the exhaust side, respectively. The intake cam shaft 38 and the exhaust cam shaft 39 are held in the plane where the cylinder head 24 and the head cover 25 are fitted together.

Referring to FIG. 5, a left balancer shaft 42 and a right balancer shaft 43 are rotatably supported on both sides of the crankshaft 21 to be parallel therewith. The left and right balancer shafts 42 and 43 serve to cancel the secondary vibration caused by the vibration of the crankshaft 21. A balancer drive gear 45 is formed on the outer circumferential surface of a frontmost crank web 44 shown in FIG. 4. On the left and right balancer shafts 42 and 43, driven gears 46 and 47 for the left and right balancers are mounted, as shown in FIG. 5, in positions corresponding to the balancer drive gears, respectively. The driven gear 46 on the left balancer shaft 42 is engaged directly with the drive gear 45. The driven gear 47 on the right balancer shaft 43 is engaged with the drive gear 45 via an intermediate gear 49. In this arrangement, as the crankshaft 21 rotates, the left and right balancer shafts 42 and 43 rotate in mutually opposing directions at a rotational speed twice as high as that of the crankshaft 21 based on a predetermined gear ratio relative to the drive gear, thereby serving to cancel the secondary vibration of the crankshaft 21.

Referring to FIG. 4, an oil tank 70 is attached to a front portion of the crankcase 22 and the cylinder block 23 combined. The oil tank 70 includes a tank body 71 and a tank cover 72. The crankshaft 21 extends to project forwardly on the oil tank side. A rotor 51 of an ACG (AC generator) 50 is attached to the forwardly projecting portion 21*a* of the crankshaft. A driven gear for the starter 54 is connected to the rear side of the rotor 51 via a one-way clutch 53. Referring to FIG. 5, a starter motor 55 is disposed leftwardly above the crankshaft 21. A pinion 56 which performs a driving function when starting the engine is fitted onto the starter motor shaft. The pinion 56 is engaged with the driven gear for the starter 54 on the crankshaft 21 via a double intermediate gear 57 for speed reduction.

Referring to FIG. 4, a rear end portion of the crankshaft 21 rearwardly projects at the rear of the crankcase 22 and the cylinder block 23 combined. A rear end portion of the rearwardly projecting portion 21*b* of the crankshaft is connected to an impeller shaft of the jet pump 7 via a coupling 58. A cam chain chamber 59 is formed inside of the rear wall of the crankshaft 22 and the cylinder block 23 combined. A cam chain 63 is stretched between a drive sprocket 60 on the crankshaft 21 and the driven sprockets 61 and 62 on the left and right cam shafts 38 and 39 causing the cam shafts 38 and 39 to be rotationally driven by the crankshaft 21.

Referring to FIG. 4, a main oil passage 65 extends, in the front-rear direction, through a lower portion of the crankcase 22. It is an oil passage for oil to lubricate the bearings and other parts of the crankshaft 21. Though not shown in FIG. 4, right and left balancer shaft lubrication oil passages 66 and 67 for oil to lubricate the bearings of the left and right balancer shafts 42 and 43 extend on both sides of, and in parallel with, the main oil passage 65 as shown in FIG. 5. These oil passages extend through the front wall of the crankcase 22 and receive oil discharged from a feed pump being described later. A long rectangular opening is formed through the bottom of the crankcase 22. The opening is covered from below by the oil pan 26 attached to the bottom.

Figure 6:
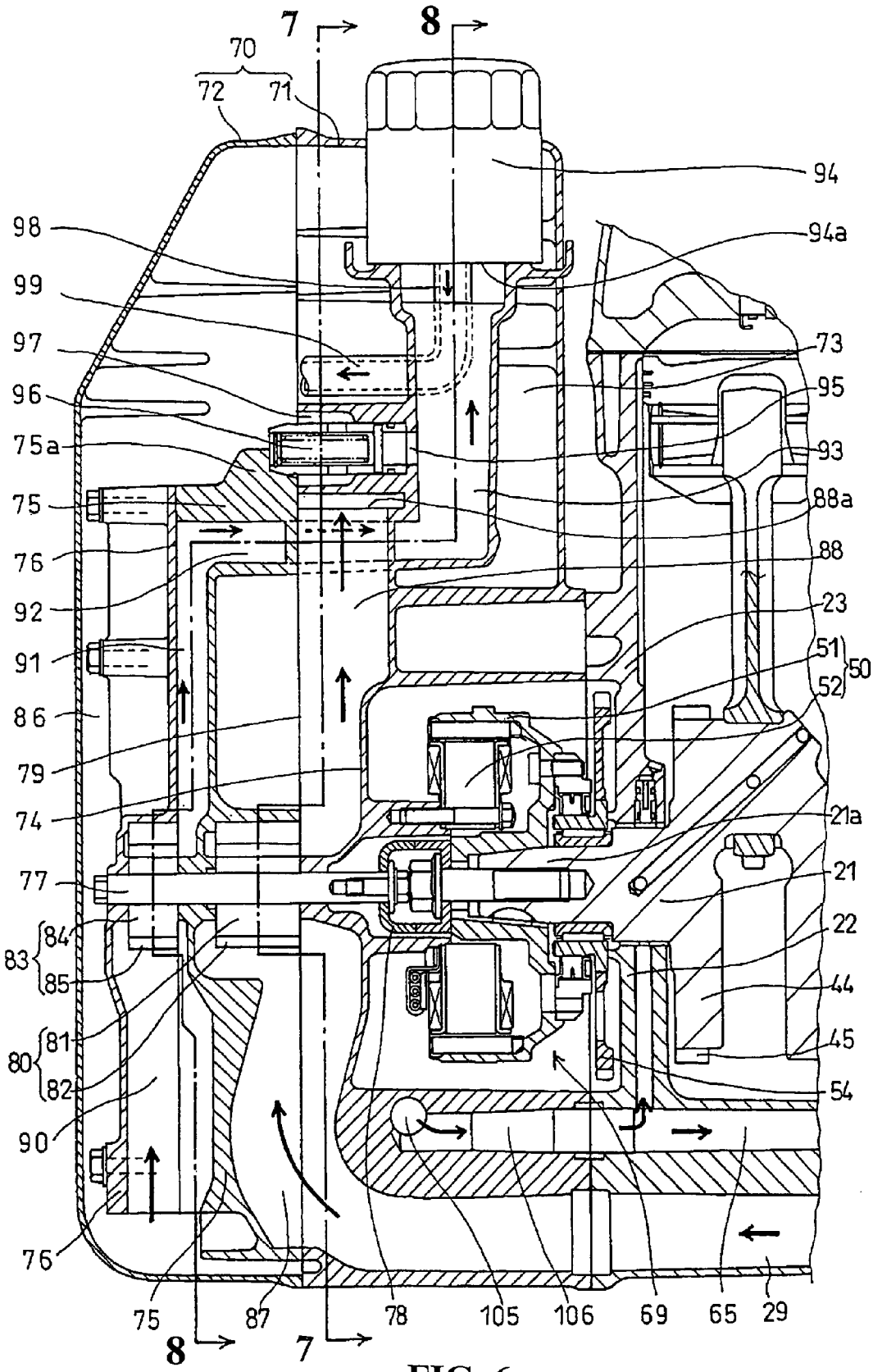
FIG. 6 is a longitudinal cross-sectional view of an oil tank in a front portion of the internal combustion engine 20.
Figure 7:
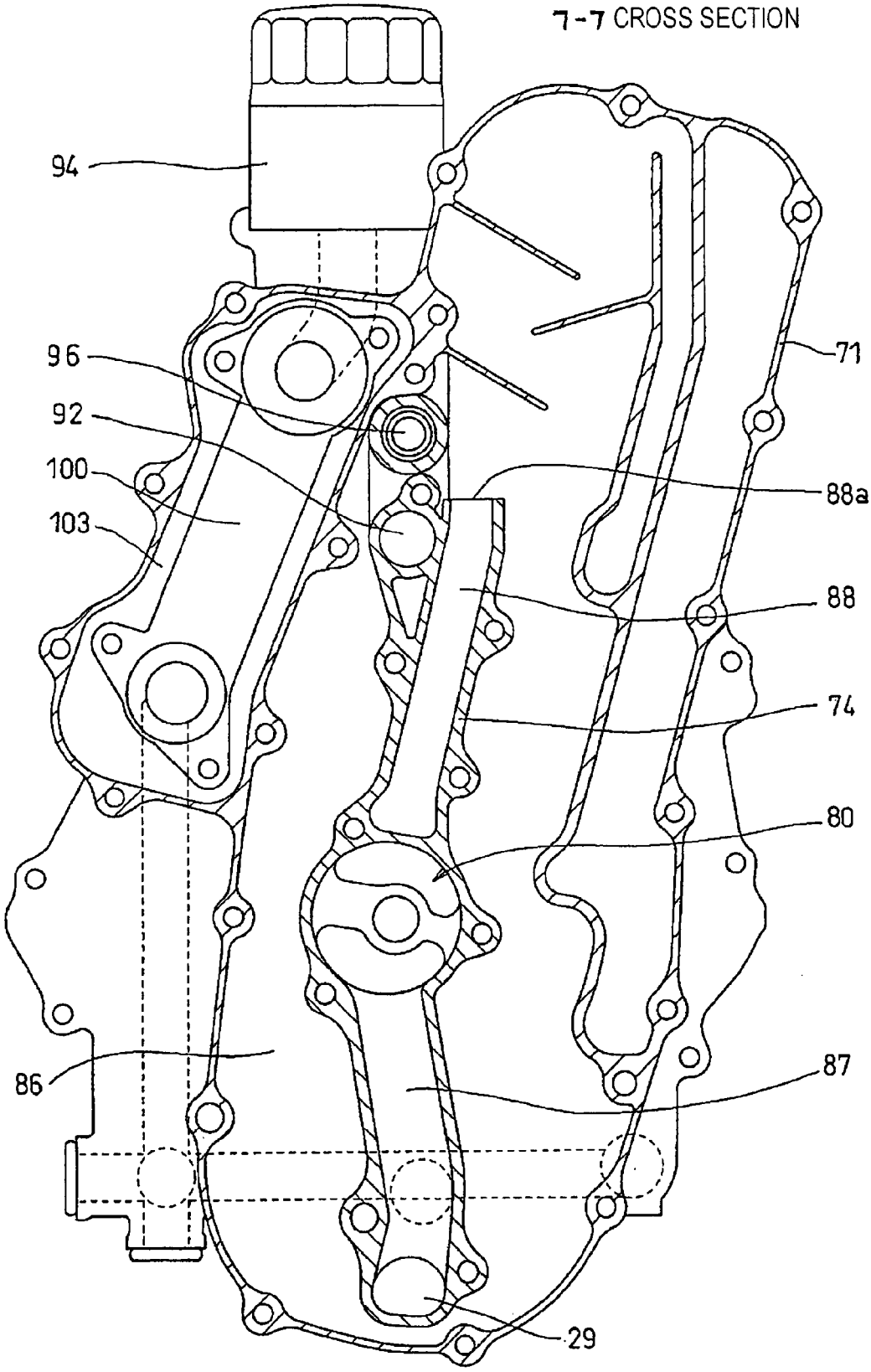
FIG. 7 is a cross-sectional view taken along line 7-7 in FIG. 6.
Figure 8:
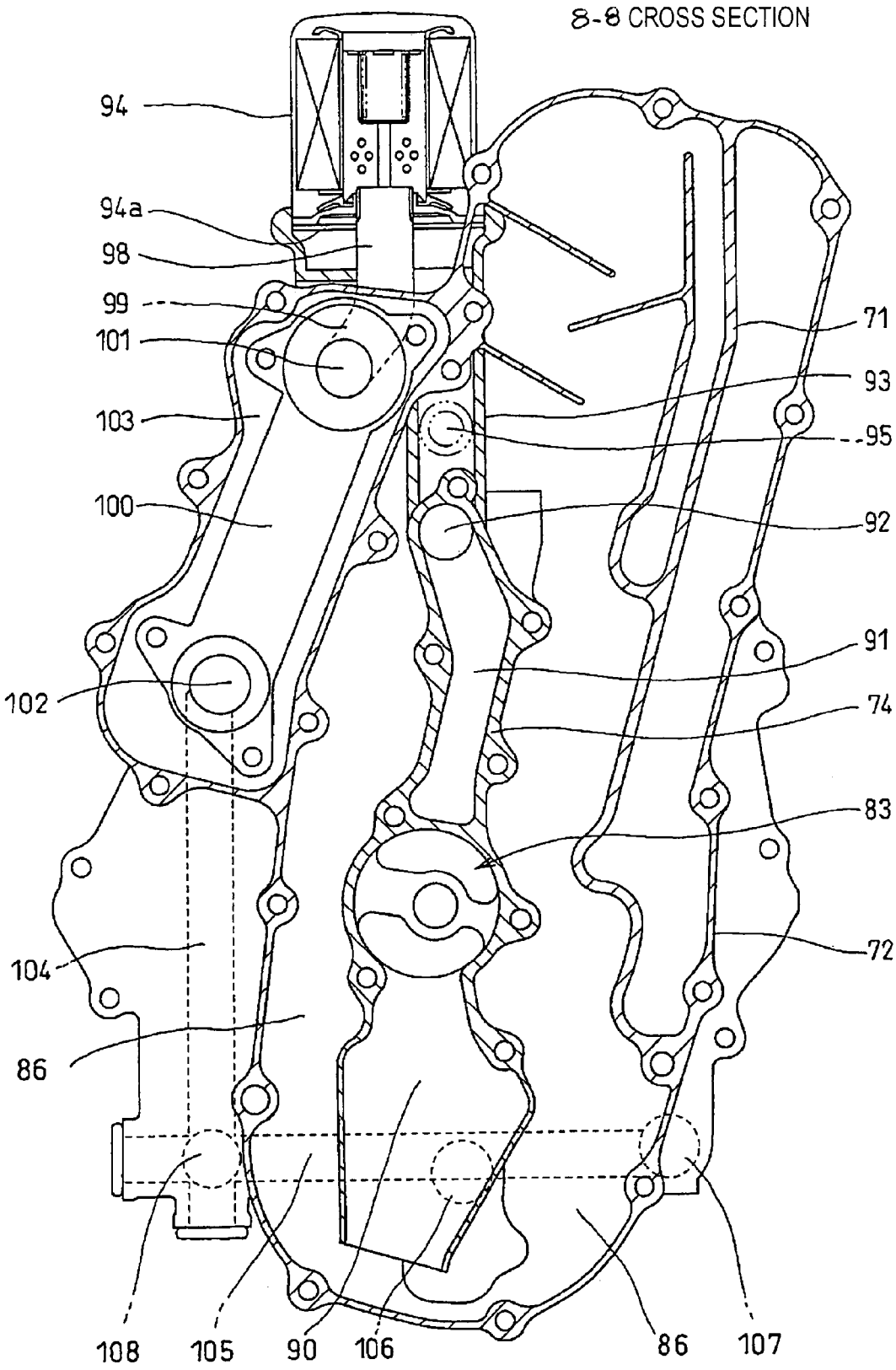
FIG. 8 is a cross-sectional view taken along line 8-8 in FIG. 6.

FIG. 6 is a longitudinal cross-sectional view of the oil tank 70 in a front portion of the internal combustion engine. FIG. 7 is a cross-sectional view taken along line 7-7 in FIG. 6. FIG. 8 is a cross-sectional view taken along line 8-8 in FIG. 6. Referring to FIG. 6, the oil tank 70 includes the tank body 71 joined to the front of the crankcase 22 and the cylinder block 23 combined and a tank cover 72 joined to the front of the tank body 71. The front end of the crankshaft 21 extends into the inside of the tank body 71. The tank body 71 integrally includes an ACG cover 74 covering a device section 69 which includes the ACG 50 provided on the forwardly projecting portion 21*a* of the crankshaft 21 and the driven gear 54 for the starter. The ACG cover 74 thus partitions the tank body 71 into the device section 69 and an oil section 73. An ACG rotor 51 is mounted on the forwardly projecting portion 21*a* of the crankshaft and an ACG stator 52 is fixedly bolted in the ACG cover 74. The oil section 73 partitioned by the ACG cover 74 to be outside the device section 69 includes an oil reservoir 86, oil passages and an oil cooler housing. Referring to FIGS. 7 and 8, an outer space partitioned by oil pump cases 75 and 76 is a part of the oil reservoir 86, that is, it is integrally communicated to the oil reservoir 86 in the tank body 71.

The scavenging pump case 75 and the feed pump case 76 are attached, in the mentioned order, to the front of the tank body 71. The tank cover 72 is attached to the front of the tank body 71 such that it covers the pump cases. A pump shaft 77, extending through the scavenging pump case 75 and the feed pump case 76, is disposed to be on an axis extended from the crankshaft 21. The pump shaft 77 is connected to the forwardly projecting portion 21*a* of the crankshaft 21 via a shaft coupling 78 inside the ACG cover 74. An inner rotor 81 of a scavenging pump 80 coupled to the pump shaft 77 is provided in the scavenging pump case 75. An outer rotor 82 of the scavenging pump 80 is rotatably mounted over the outer circumference of the inner rotor 81. An inner rotor 84 of a feed pump 83 coupled to the pump shaft 77 is provided in the feed pump case 76. An outer rotor 85 of the feed pump 83 is rotatably mounted over the outer circumference of the inner rotor 84.

Referring to FIGS. 6 and 7, in the tank body 71, an oil passage for oil for the scavenging pump 80 is formed between the front of the ACG cover 74 and the back of the scavenging pump case 75. An oil recovery passage 87 communicated to the oil pan 26 via an oil passage 29 leading to the oil pan is formed under the scavenging pump 80. An oil discharge passage 88 is formed over the scavenging pump 80. An upper end of the oil discharge passage 88 forms an upper opening 88*a* through which the oil discharge passage 88 is open to the oil reservoir 86.

Referring to FIGS. 6 and 8, an oil passage for supplying oil to the feed pump 83 is formed between the front of the scavenging pump case 75 and the back of the feed pump case 76. An oil intake passage 90 open to a bottom portion of the oil reservoir 86 is formed under the feed pump 83. An oil discharge passage 91 is formed over the feed pump 83. The oil discharge passage 91 extends upward and, at its upper end, the passage changes its direction to further extend, as a horizontal oil passage 92, horizontally into the tank body 71. In the tank body, the passage again changes its direction to further extend, as an upward oil passage 93, upward in parallel with a junction plane 79 between the scavenging pump case 75 and the tank body 71. The upper end of the upward oil passage 93 is in communication with an annular oil inlet 94*a* formed in the bottom surface of an oil filter 94, allowing oil to flow into the oil filter 94.

Referring to FIGS. 6 and 8, an opening 95 for pressure reception by a relief valve is provided halfway up the upward oil passage 93. A relief valve 96 is installed by fitting its inside end portion horizontally into the opening 95 for the relief valve from the tank cover 72 side and installing the scavenging pump case 75 in a position so that an outside end portion of the relief valve 96 is held by a relief valve holding portion 75*a* provided in an upper part of the scavenging pump case 75. In this way, the relief valve 96 is fixed between the tank body 71 and the scavenging pump case 75. When a high discharge pressure causes oil to flow out through a side of the relief valve 96, the oil is led to the oil reservoir 86 via a clearance 97 formed around the relief valve 96 inside the tank body 71.

Referring to FIGS. 6 and 8, oil cleaned by the oil filter 94 flows out through an oil outlet pipe 98 projecting downwardly from a center portion of the oil filter bottom. The oil outlet pipe 98, extending downward from the oil filter, changes its direction below the oil filter to further extend horizontally as a passage to oil cooler 99 which is in communication with an oil cooler 100. The oil cooler 100 is housed in an oil cooler housing 103 formed, straddling the tank body 71 and the tank cover 72, beside the oil reservoir 86. Oil flows into the oil cooler 100 through an oil cooler inlet 101 provided in an upper portion of the oil cooler 100, then after flowing downwardly, flows out through an oil cooler outlet 102 provided in a lower portion of the oil cooler 100. An arrangement is made such that, in the oil cooler housing 103, cooling seawater is circulated from a lower portion upward over the outer circumference of the oil cooler 100. Referring to FIG. 8, the oil flowing out through the oil cooler outlet 102 after being cooled by the oil cooler 100 is sent to oil transfer passages 104 and 105. The oil is then sent to the main oil passage 65, left balancer shaft lubrication oil passage 66, and right balancer shaft lubrication oil passage 67, which are shown in FIG. 5, via connection holes 106, 107, and 108 provided for supplying oil to the corresponding the main oil passage, and the oil passages for lubricating the left and right balancer shafts respectively. The oil sent out to the oil passages is supplied to various parts of the internal combustion engine 20 for lubrication.

As described in detail above, in the present embodiment, the relief valve 96 is fixed in a simple way, so that it is possible to reduce the number of components and shorten the assembly process. Furthermore, since the relief valve 96 is positioned other than in front of the oil pump 80 or 83, the dimension in the front-rear direction of the front portion of the oil tank 70 can be reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubricating apparatus for an internal combustion engine, comprising:

a tank body attached to an end face of an internal combustion engine crankcase;

an oil pump case attached to an end face of the tank body, the oil pump case housing an oil pump; and a tank cover attached to the tank body, the tank cover covering the oil pump case;

wherein an oil discharge passage extending from the oil pump is provided straddling the oil pump case and the tank body;

a direction of extension of the oil discharge passage is changed in the tank body such that the oil discharge passage further extends, in the tank body, in parallel with a junction plane between the oil pump case and the tank body;

an opening for pressure reception by relief valve is provided in the oil discharge passage portion extending in parallel with the junction plane;

an inside end portion of the relief valve is fitted into the opening in a direction in which the oil pump case is attached; and by attaching the oil pump case such that an outside end portion of the relief valve is held by a portion of the oil pump case, the relief valve is fixed between the tank body and the oil pump case.

2. The lubricating apparatus for an internal combustion engine according to claim 1, wherein the tank body includes an AC generator cover for covering the AC generator, a forward projecting portion of a crankshaft and a driven gear for a starter.

3. The lubricating apparatus for an internal combustion engine according to claim 1, wherein said oil pump includes a scavenging pump case including a scavenging pump and a feed pump case including a feed pump being operatively connected to the tank body with a pump shaft extending therethrough, said pump shaft being operatively connected to a crankshaft.

4. The lubricating apparatus for an internal combustion engine according to claim 3, and further including an inner rotor of the scavenging pump being coupled to the pump shaft and being operatively provided within the scavenging pump case.

5. The lubricating apparatus for an internal combustion engine according to claim 4, and further including an outer rotor of the scavenging pump being coupled to the pump shaft and being rotatably mounted over an outer circumference of the inner rotor.

6. The lubricating apparatus for an internal combustion engine according to claim 3, and further including an inner rotor of the feed pump being coupled to the pump shaft and being operatively provided within the feed pump case.

7. The lubricating apparatus for an internal combustion engine according to claim 6, and further including an outer rotor of the feed pump being coupled to the pump shaft and being rotatably mounted over an outer circumference of the inner rotor.

8. The lubricating apparatus for an internal combustion engine according to claim 1, wherein the relief valve is installed by fitting an inside end portion substantially horizontally into the opening for the pressure reception by the relief valve and installing a scavenging pump case wherein an outside end portion of the relief valve is held by the scavenging pump case.

9. The lubricating apparatus for an internal combustion engine according to claim 1, wherein the relief valve is disposed to be offset a predetermined distance and not aligned relative to the oil pump.

10. The lubricating apparatus for an internal combustion engine according to claim 1, and further including an oil cooler operatively positioned relative to the tank body for cooling the oil disposed therein.

11. A lubricating apparatus for an internal combustion engine, comprising:

a tank body attached to an end face of an internal combustion engine crankcase;

an oil pump case attached to an end face of the tank body, the oil pump case housing an oil pump; and a tank cover attached to the tank body, the tank cover covering the oil pump case;

an oil discharge passage extending from the oil pump and straddling the oil pump case and the tank body;

a relief valve;

an opening for the relief valve being provided in the oil discharge passage portion extending in parallel with the junction plane;

an inside end portion of the relief valve being fitted into the opening; and an outside end portion of the relief valve being held by a portion of the oil pump case, the relief valve being fixed between the tank body and the oil pump case.

12. The lubricating apparatus for an internal combustion engine according to claim 11, wherein the tank body includes an AC generator cover for covering the AC generator, a forward projecting portion of a crankshaft and a driven gear for a starter.

13. The lubricating apparatus for an internal combustion engine according to claim 11, wherein said oil pump includes a scavenging pump case including a scavenging pump and a feed pump case including a feed pump being operatively connected to the tank body with a pump shaft extending therethrough, said pump shaft being operatively connected to a crankshaft.

14. The lubricating apparatus for an internal combustion engine according to claim 13, and further including an inner rotor of the scavenging pump being coupled to the pump shaft and being operatively provided within the scavenging pump case.

15. The lubricating apparatus for an internal combustion engine according to claim 14, and further including an outer rotor of the scavenging pump being coupled to the pump shaft and being rotatably mounted over an outer circumference of the inner rotor.

16. The lubricating apparatus for an internal combustion engine according to claim 13, and further including an inner rotor of the feed pump being coupled to the pump shaft and being operatively provided within the feed pump case.

17. The lubricating apparatus for an internal combustion engine according to claim 16, and further including an outer rotor of the feed pump being coupled to the pump shaft and being rotatably mounted over an outer circumference of the inner rotor.

18. The lubricating apparatus for an internal combustion engine according to claim 11, wherein the relief valve is installed by fitting an inside end portion substantially horizontally into the opening for the relief valve and installing a scavenging pump case wherein an outside end portion of the relief valve is held by the scavenging pump case.

19. The lubricating apparatus for an internal combustion engine according to claim 11, wherein the relief valve is disposed to be offset a predetermined distance and not aligned relative to the oil pump.

20. The lubricating apparatus for an internal combustion engine according to claim 11, and further including an oil cooler operatively positioned relative to the tank body for cooling the oil disposed therein.

* * * * *